US008994260B1

(12) United States Patent
Kumar et al.

(10) Patent No.: US 8,994,260 B1
(45) Date of Patent: Mar. 31, 2015

(54) STRUCTURE AND METHOD FOR SINGLE CRYSTAL SILICON-BASED PLASMA LIGHT SOURCE AND FLAT PANEL DISPLAY PANELS AND MICRO PLASMA SOURCES

(71) Applicants: Srinivas H. Kumar, Fremont, CA (US); Ananda H. Kumar, Fremont, CA (US); Tue Nguyen, Fremont, CA (US)

(72) Inventors: Srinivas H. Kumar, Fremont, CA (US); Ananda H. Kumar, Fremont, CA (US); Tue Nguyen, Fremont, CA (US)

( * ) Notice: Subject to any disclaimer, the term of this patent is extended or adjusted under 35 U.S.C. 154(b) by 0 days.

(21) Appl. No.: 14/046,925

(22) Filed: Oct. 5, 2013

Related U.S. Application Data

(60) Provisional application No. 61/710,682, filed on Oct. 6, 2012.

(51) Int. Cl.

| | |
|---|---|
| ***H01J 1/62*** | (2006.01) |
| ***H01J 1/30*** | (2006.01) |
| ***H01J 9/02*** | (2006.01) |

(52) U.S. Cl.
CPC .. *H01J 1/30* (2013.01); *H01J 9/025* (2013.01)
USPC ..... 313/485; 313/495; 257/347

(58) Field of Classification Search
USPC ..... 313/485, 495; 257/347
See application file for complete search history.

(56) References Cited

U.S. PATENT DOCUMENTS

| | | | | |
|---|---|---|---|---|
| 3,953,264 | A * | 4/1976 | Wu | 438/21 |
| 5,062,689 | A * | 11/1991 | Koehler | 359/230 |
| 5,153,702 | A * | 10/1992 | Aoyama et al. | 257/347 |
| 6,249,083 | B1 * | 6/2001 | Kim | 313/495 |
| 6,444,584 | B1 * | 9/2002 | Hsiao | 438/706 |
| 7,259,508 | B2 * | 8/2007 | Witmer | 313/475 |
| 2005/0098855 | A1 * | 5/2005 | Shimoji et al. | 257/621 |

* cited by examiner

*Primary Examiner* — Mary Ellen Bowman

(57) ABSTRACT

Silicon substrate having (100) crystal orientation can be wet etched to form (111) sharp tip pyramids. The sharp tip pyramids can be used to fabricate electrodes for flat panel displays, such as a plasma display panel or a field emission display.

20 Claims, 11 Drawing Sheets

STRUCTURE AND METHOD FOR SINGLE CRYSTAL SILICON-BASED PLASMA LIGHT SOURCE AND FLAT PANEL DISPLAY PANELS AND MICRO PLASMA SOURCES

The present application claims priority from provisional application Ser. No. 61/710,682, filing date Oct. 6, 2012, entitled "Structure and method for single crystal silicon-based plasma light source and flat panel display panels and micro plasma sources", hereby incorporated by reference.

BACKGROUND

Flat panel displays can be fabricated with planar electrodes. For example, plasma displays can include a discharge space positioned between two flat electrodes. When an electric field is established between the two electrodes, the discharge space can be excited to emit visible light, forming a pixel in an image.

There are several important advantages to be gained when one of the electrodes is a fine tip or an array of closely packed fine tips. For example, lower voltage of operation and higher brightness can be obtained with such fine tips. In addition, the sharp tip electrodes can be used in other flat panel displays, such as field emission displays.

SUMMARY

Silicon substrate having (100) crystal orientation can be wet etched to form (111) sharp tip pyramids. The sharp tip pyramids can be used to fabricate electrodes for flat panel displays, such as a plasma display panel or a field emission display.

DETAIL DESCRIPTION OF THE EMBODIMENTS

A plasma display panel (PDP) can include a discharge space formed between two substrates. The discharge space can be partitioned into multiple discharge cells, for example, by barrier ribs. A display electrode and a data electrode can be used on the two substrates to generate discharge in the discharge cells. Phosphor coatings that can emit different color light, e.g., red, green or blue light, by discharge can be provided on the substrate. Ultraviolet light can be generated by a discharge, for example, by applying a voltage to the two electrodes, which can respectively emits red, green and blue visible light from the discharge cells to display an image. The display electrode and the data electrode can be configured as a cross point array, with the discharge cell at the cross section of a display electrode line and a data electrode line experiencing the electric field to generate the visible light.

Figure 1:
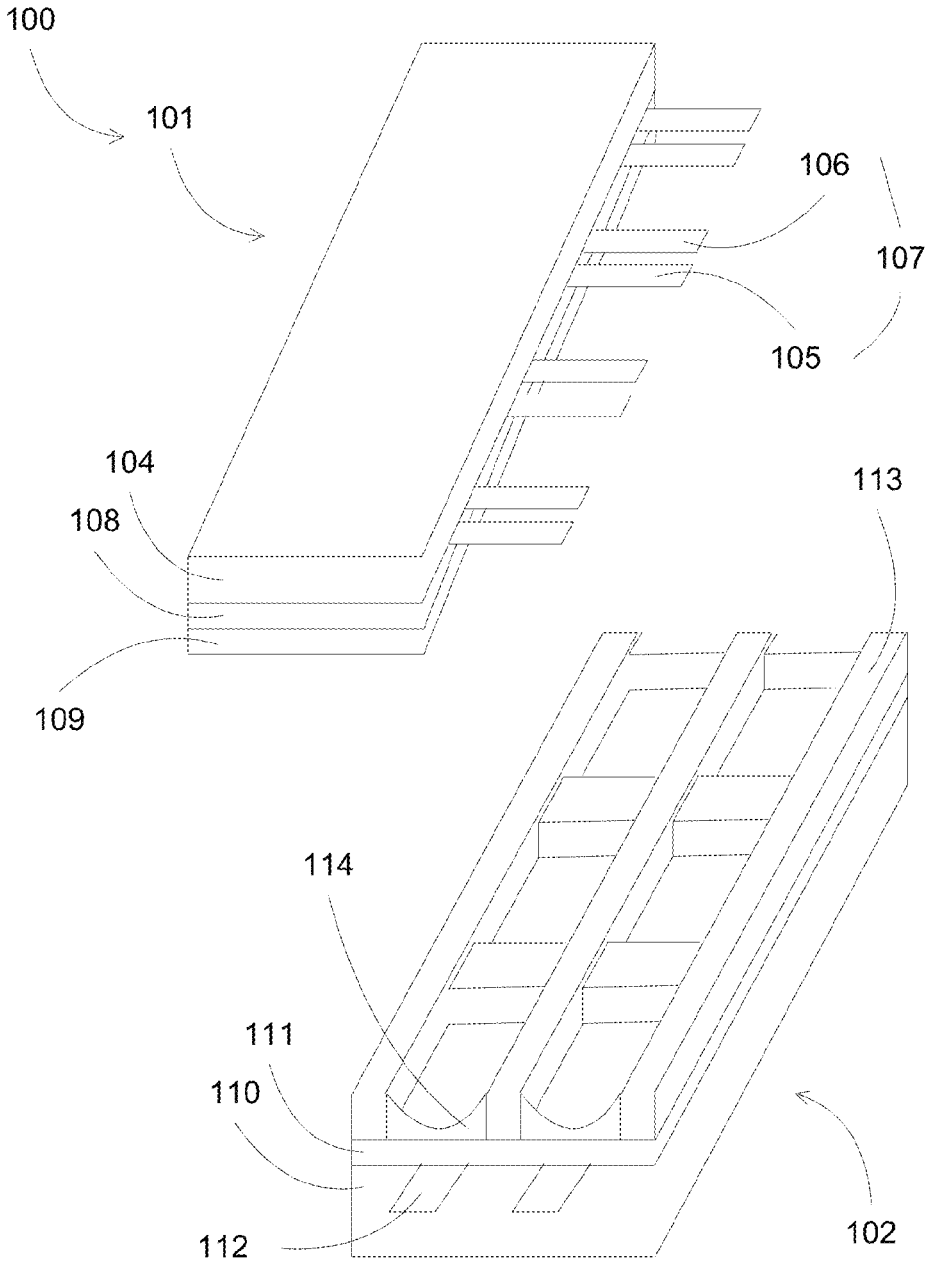
FIG. 1 illustrates an exploded perspective view showing a plasma display panel according to some embodiments.

FIG. 1 illustrates an exploded perspective view showing a plasma display panel according to some embodiments. A plasma display panel 100 can include two plates 101 and 102. The plates can be placed opposite each other to form a discharge space. The top plate 101 can include a substrate 104, multiple display electrodes 107, a dielectric layer 108 and a protective layer 109. The display electrodes 107 can be arranged in row direction on the substrate 104. A display electrode can include a scan electrode 105 and a sustain electrode 106, disposed in parallel to each other. The substrate and the dielectric layer can be made from transparent materials, such as glass panels. The display electrodes can also be made of transparent materials, such as transparent conductive materials of indium tin oxide (ITO).

The bottom plate 102 can include a substrate 110, an insulating layer 111, multiple data electrodes 112, barrier ribs 113 and phosphor layers 114. The data electrodes 112 can be arranged in column direction on the substrate 110, and covered with the insulating layer 111. Barrier ribs 113 can be formed on the insulating layer 111, partitioning the discharge space between the top plate 1 and the bottom plate 102 to multiple separate discharge cell. Red, green and blue phosphor layers can be coated on the surface areas of the discharge cells, such as the front face of the insulating layer 111 and the side faces of barrier ribs 113.

Figure 2A:
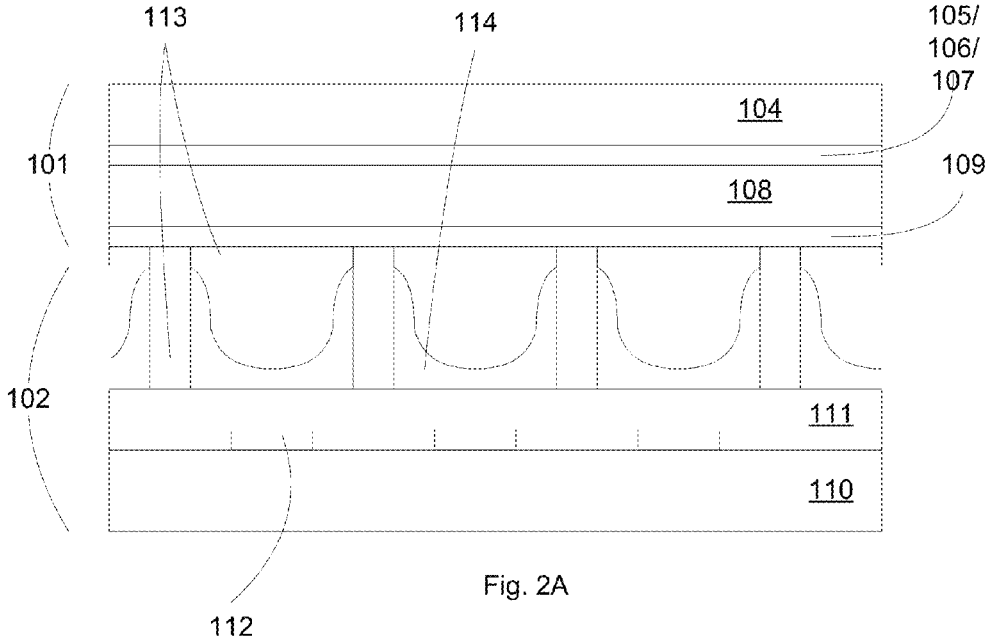
FIGS. 2A-2B illustrate cross sectional views showing a portion of the discharge space of a plasma display panel according to some embodiments.
Figure 2B:
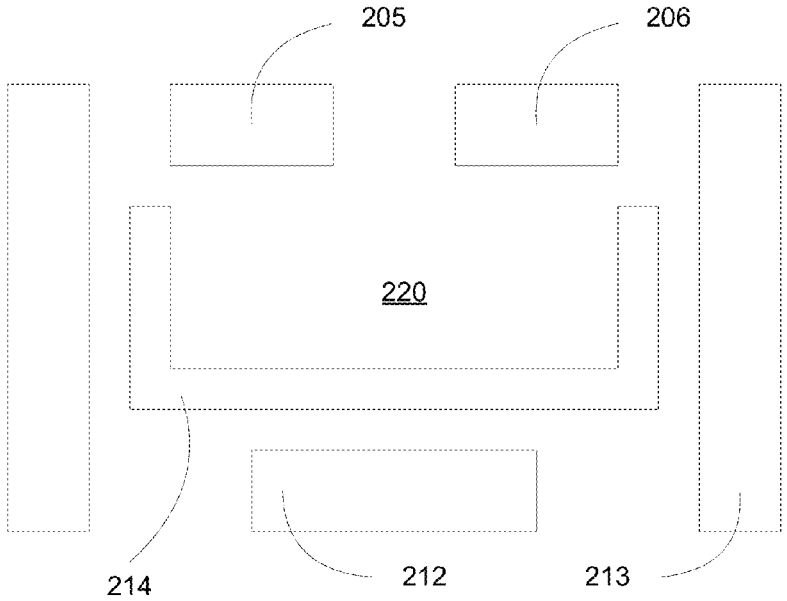

FIGS. 2A-2B illustrate cross sectional views showing a portion of the discharge space of a plasma display panel according to some embodiments. In FIG. 2A, the top plate 101 can include a substrate 104, display electrodes 107 (including scan electrodes 105 and sustain electrodes 106), insulating layer 108 and protective layer 109. The bottom plate 2 can include a substrate 110, data electrodes 112, and insulating layer 111. Barrier ribs 113 can be used to form the separate discharge cells, including the top portion at the protective layer 109 and the side portion between the discharge cells. Phosphor layers 114, different color for adjacent discharge cells, can be coated on the discharge cells.

In FIG. 2B, a schematic of a discharge cell is shown. The display electrodes, e.g., the scan electrode 205 and the sustain electrode 206, are shown separately on top of the discharge cell. At the bottom of the discharge cell is the data electrode 212. Barrier ribs 213 can be used to isolate the discharge cell. A phosphor coating 214 can be used to coat the interior surface of the discharge cell. The discharge cell can include a discharge gas 220, such as xenon or neon.

Figure 3:
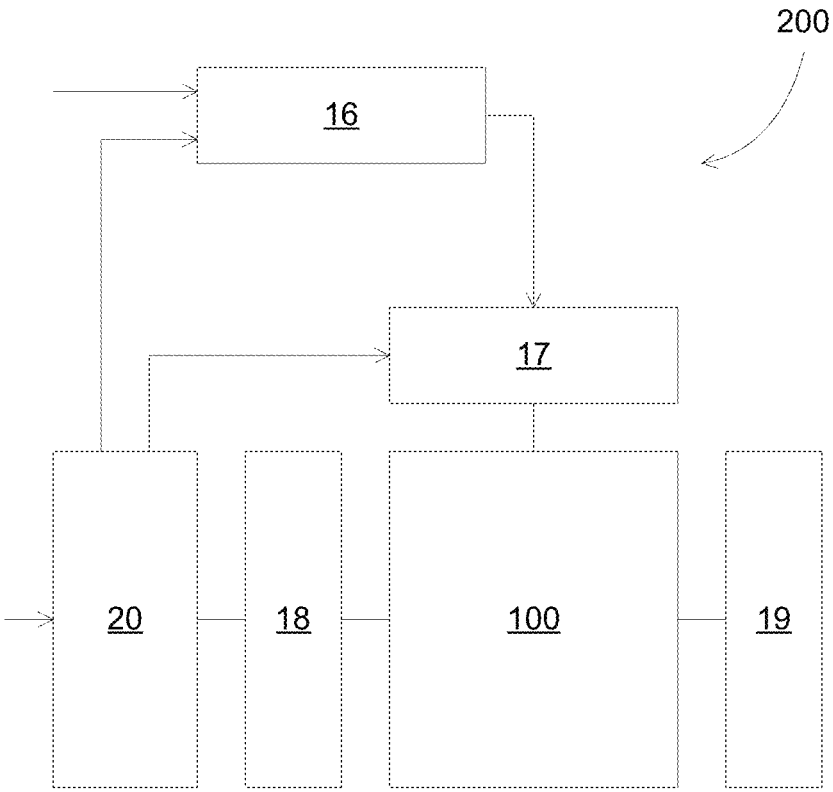
FIG. 3 illustrates a block diagram showing an overall configuration of a plasma display panel according to some embodiments.

FIG. 3 illustrates a block diagram showing an overall configuration of a plasma display panel according to some embodiments. A plasma display panel 200 can include an image signal processing circuit 16, data electrode drive circuit 17, scan electrode drive circuit 18, sustain electrode drive circuit 19, timing generation circuit 20, and a power supply circuit. Data electrode drive circuit 17 is coupled to data electrodes in a plasma display panel. Scan electrode drive circuit 18 is coupled to scan electrodes, and sustain electrode drive circuit 19 is coupled to sustain electrodes in a plasma display panel. In operation, the image signal processing circuit 16 can convert image signal to image data. The data electrode drive circuit 17 converts the image data to drive respective data electrodes. The timing generation circuit 20 generates timing signals based on horizontal synchronizing signal and vertical synchronizing signal.

In some embodiments, methods and apparatuses are provided for making flat panel displays having sharp tip electrodes. The sharp tip electrodes can be fabricated using single crystal silicon substrates.

Finely polished silicon (100) wafers the same size as of the desired display unit, or larger, can be used as a starting substrate. One surface of the wafer can be anisotropically etched under conditions that produce a closely spaced array of pyramids bound by (111) surfaces. The etchants can include potassium hydroxide or mild organic base such as tetramethylammonium hydroxide (TMAH). Other etchants that can etch silicon can be used. To produce a dense array the etchant can be diluted, e.g., the etching can be performed in the presence of a solvent such as isopropyl alcohol (IPA) and an etching temperature of 70° C. to 80° C., for about 30 minutes. Under these conditions, the entire (100) surface will be covered by these diamond-shaped pyramids, 3-10 micron in height, and joined at their bases. This etching can be considered as self-limiting, because once the entire surface is paved with these (111) pyramids, the etching stops. The tips of these (111) pyramids are atomically sharp. This sharpness is naturally achieved chemically by the anisotropic nature of the etching process, and sharper than any mechanically produced tips. The heights and spacing's of these tips are in a narrow range of distribution. The self-limiting nature of the etching makes it very easy to make and control the tip array. This silicon wafer with this array of pyramid shaped tips of the plasma displays, or of field ion displays to a great advantage.

Figure 4A:
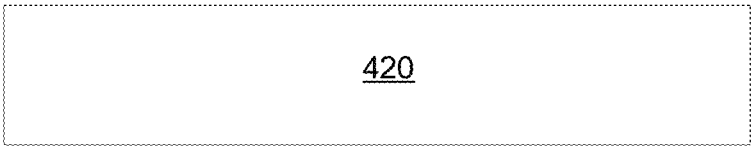
FIGS. 4A-4C illustrate an example of a fabrication process sequence according to some embodiments.
Figure 4B:
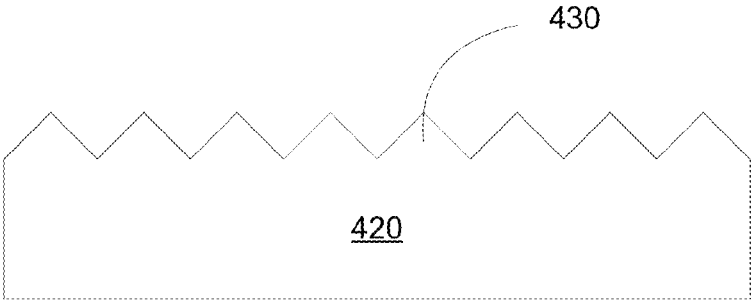
Figure 4C:
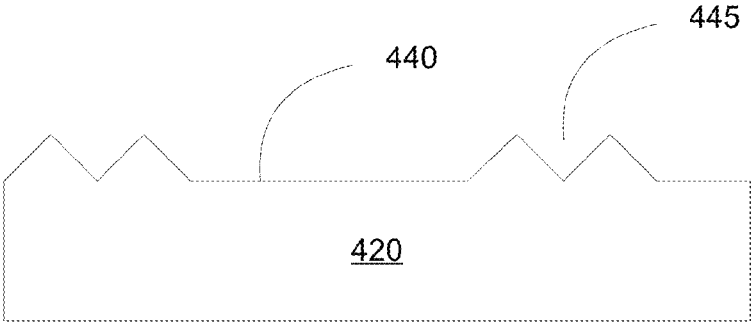

FIGS. 4A-4C illustrate an example of a fabrication process sequence according to some embodiments. In FIG. 4A, a silicon-containing substrate 420, such as a single crystal silicon having (100) surface crystal orientation is provided. In FIG. 4B, a wet etch process can be performed to form pyramids 430. In FIG. 4C, the substrate 420 can be patterned, for example, to form sharp tip electrode lines 445 separated by flat areas 440.

Figure 5:
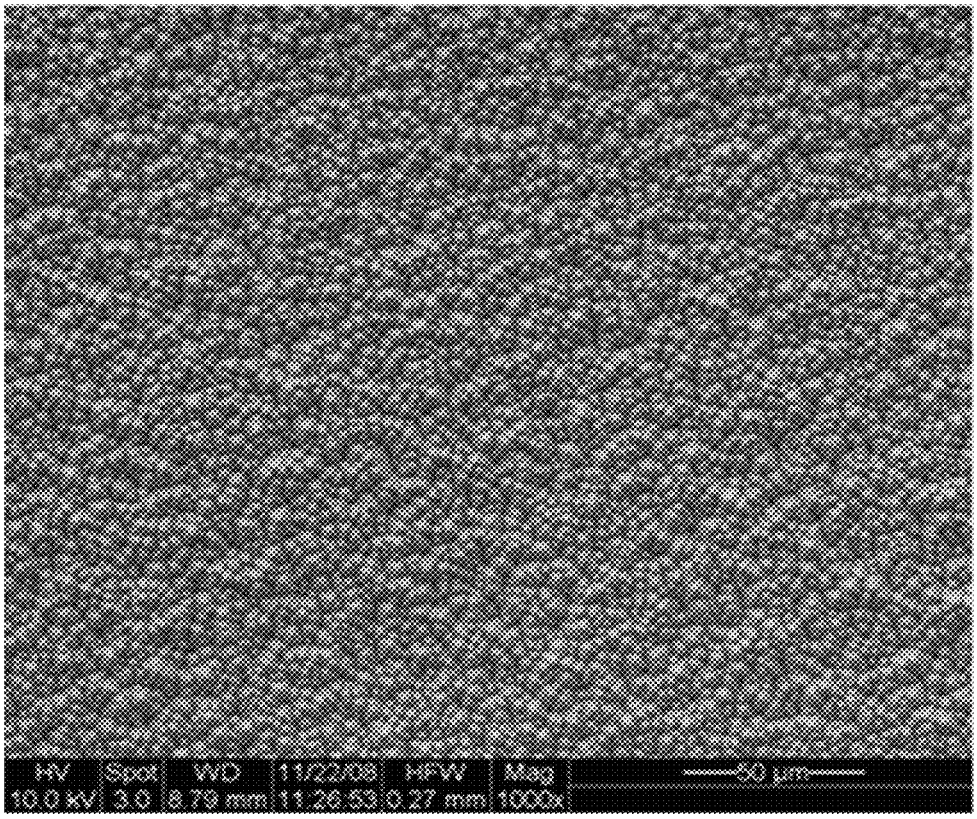
FIG. 5 illustrates an example of a pyramid tip silicon substrate according to some embodiments.

FIG. 5 illustrates an example of a pyramid tip silicon substrate according to some embodiments. The pyramid distribution can be reasonably uniform, with the size of the pyramids in order of a few microns.

Figure 6A:
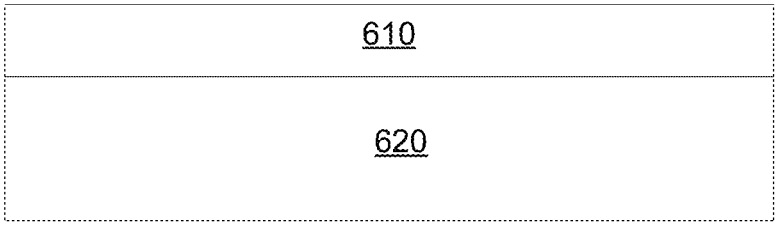
FIGS. 6A-6C illustrate an example of a fabrication process sequence according to some embodiments.
Figure 6B:
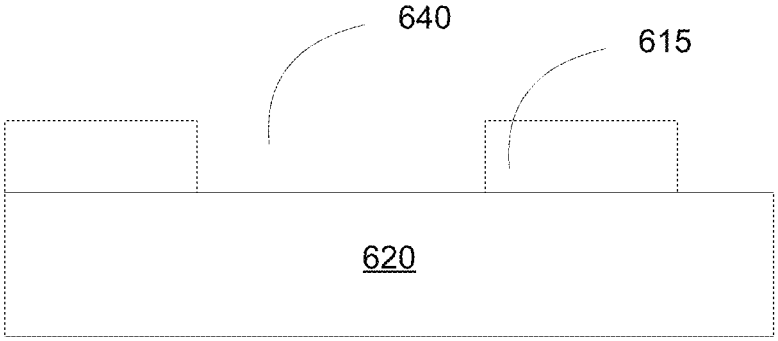
Figure 6C:
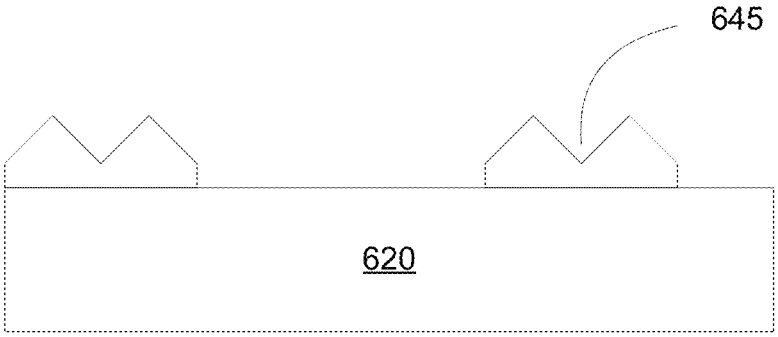

FIGS. 6A-6C illustrate an example of a fabrication process sequence according to some embodiments. In FIG. 6A, a multilayer substrate is provided. The multilayer substrate can include a silicon-containing layer 610, such as a single crystal silicon layer having (100) surface crystal orientation, disposed on a substrate 620, such as an insulator substrate. In FIG. 6B, the silicon layer 610 is patterned, for example, etching areas 640 by photolithography, to form electrodes 615. The patterns can include parallel lines for used in a cross array of a flat panel display. In FIG. 6C, a wet etch process can be performed to form sharp tip electrode lines 445 having pyramid tips.

In some embodiments, the multilayer substrate can include a single crystal silicon disposed on a ceramic substrate. The structure and fabrication process sequence can include bonding a silicon layer to a ceramic substrate, as disclosed in co-pending patent application Ser. No. 13/557,209, filed on Jul. 25, 2012, hereby incorporated by reference in it entirety.

When used as a micro-array tips for plasma displays, the silicon wafer can be heavily doped to be conductive. A thick oxide can be grown on the tips to serve as the dielectric coating. A glass plate coated on the one side with transparent conducting oxide, such as indium tin oxide, ITO, serves as the planar electrode of the display.

When used as a micro-array tips for field-ion displays, the silicon wafer can be heavily doped to be conductive. A layer of tungsten or other suitable metal is coated on the tips. A glass plate coated on the one side with transparent conducting oxide, such as indium tin oxide, ITO, serves as the planar electrode of the display. The driver devices and the circuits could be fabricated on the other side of single crystal silicon wafer. The displays could be configured as general area lighting sources, or they can be made into displays comprised of individually addressable pixels, by the usual methods.

Figure 7A:
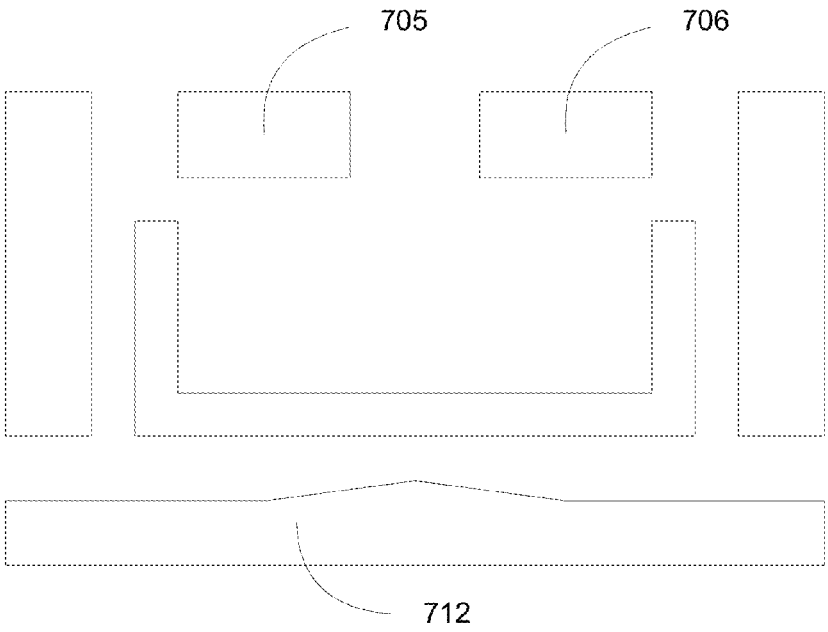
FIGS. 7A-7B illustrate an example of a discharge cell for a plasma display panel according to some embodiments.
Figure 7B:
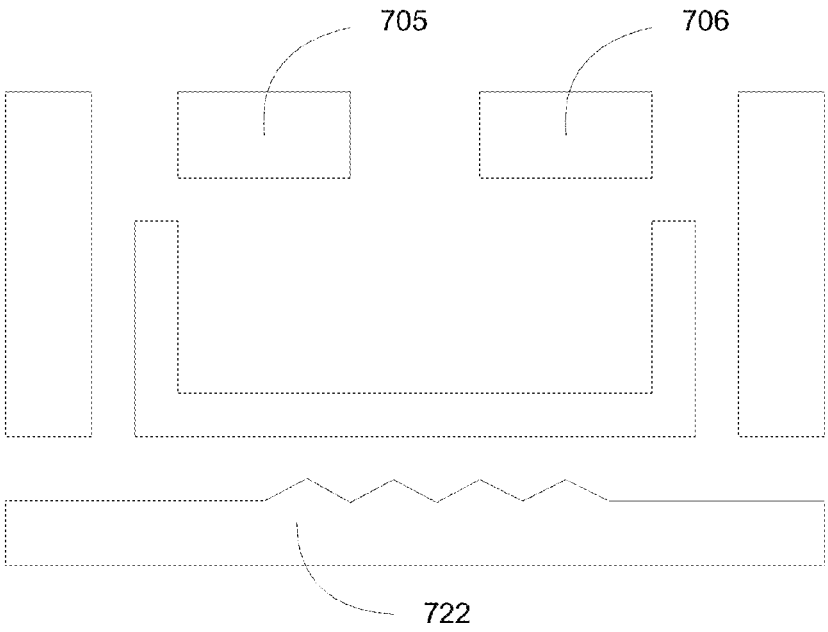

FIGS. 7A-7B illustrate an example of a discharge cell for a plasma display panel according to some embodiments. In FIG. 7A, a data electrode 712 can include a sharp tip electrode, for example, fabricated from silicon substrates. In FIG. 7B, a data electrode 722 can include multiple sharp tip electrodes. The scan 705 and sustain electrodes 706 can include flat electrodes.

Figure 8A:
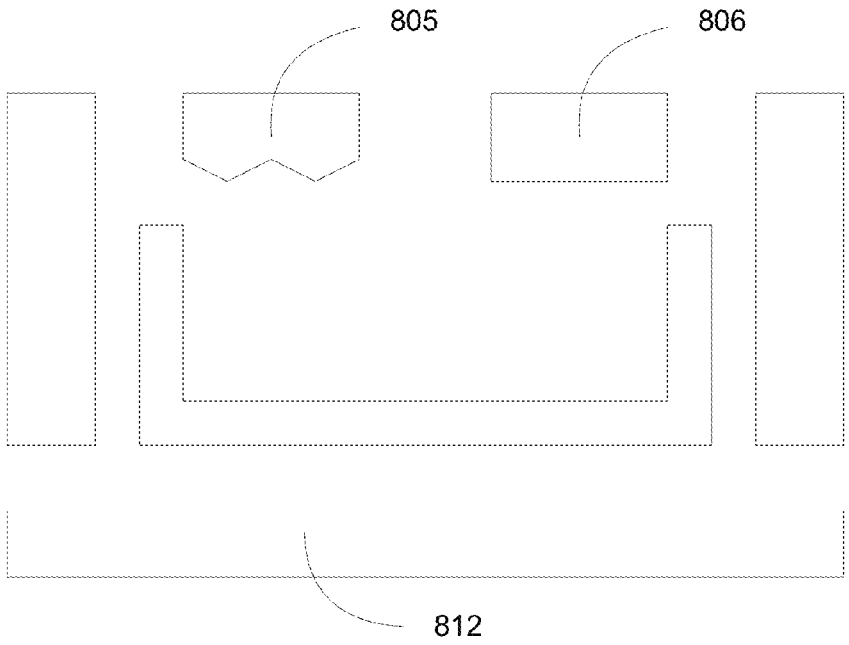
FIGS. 8A-8B illustrate an example of a discharge cell for a plasma display panel according to some embodiments.
Figure 8B:
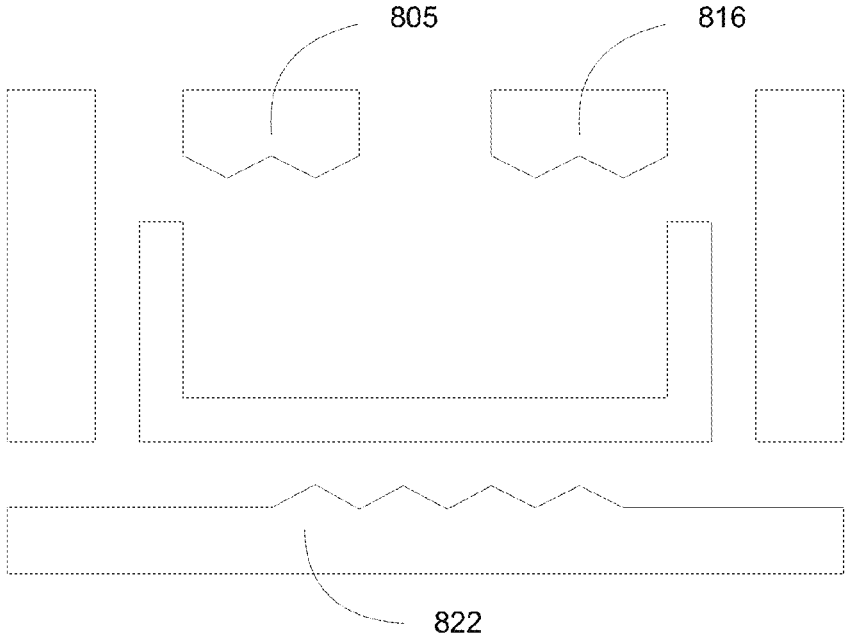

FIGS. 8A-8B illustrate an example of a discharge cell for a plasma display panel according to some embodiments. In FIG. 8A, a scan electrode 805 can include a sharp tip electrode, for example, fabricated from silicon substrates. Alternatively, the sustain electrode 806 and data electrode 812 can include sharp tip electrodes (not shown). In FIG. 8B, a data electrode 822, scan electrode 805, and sustain electrode 816 can include multiple sharp tip electrodes.

In some embodiments, the sharp tip electrodes using silicon substrate can be used in field emission displays. A field emission display can use sharp tip emitter sites to emit electrons. When a high voltage is applied to the emitter sites, the emitter sites release electrons which strike the display screen's phosphor coating.

Figure 9A:
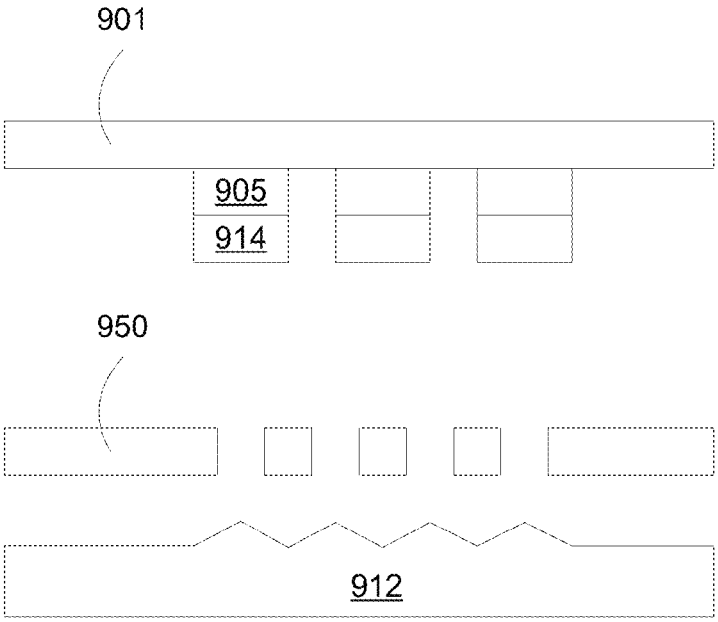
FIG. 9A illustrates a schematic of a field emission display according to some embodiments.

FIG. 9A illustrates a schematic of a field emission display according to some embodiments. A silicon substrate 912 having pyramid sharp tip can be used as emitter sites. Phosphor layers 914, for example, having different colors or each pixel, can be coated on electrodes 905. The electrodes 905 can be placed on a transparent substrate 901, such as a glass substrate. Screen 950 can be used to control the emission of the electrons from the emitter sites from the silicon substrate 912.

Figure 9B:
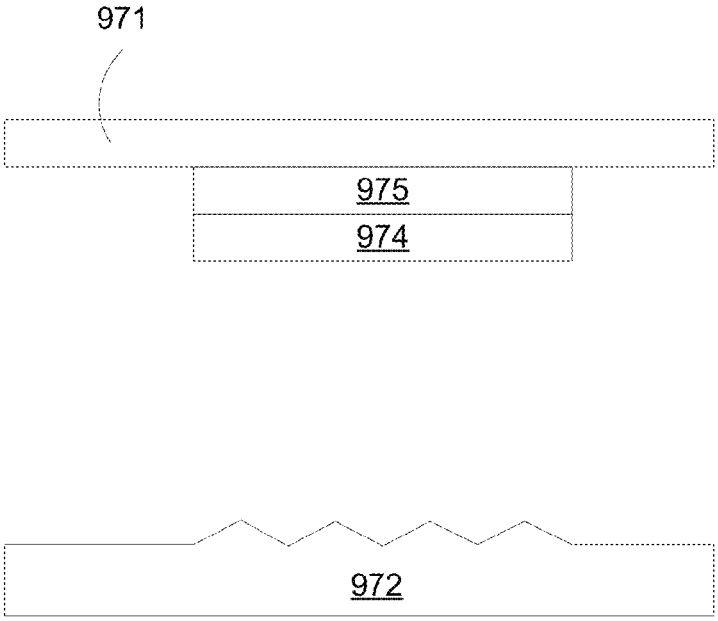
FIG. 9B illustrates a lighting device according to some embodiments.

FIG. 9B illustrates a lighting device according to some embodiments. A silicon substrate 972 having pyramid sharp tip can be used as emitter sites. Phosphor layers 974 can be coated on electrodes 975. The electrodes 975 can be placed on a transparent substrate 971, such as a glass substrate. When a voltage is applied to the silicon emitter site 972, electrons can be emitted, striking the phosphor layer 974 to emit visible light.

Figure 10:
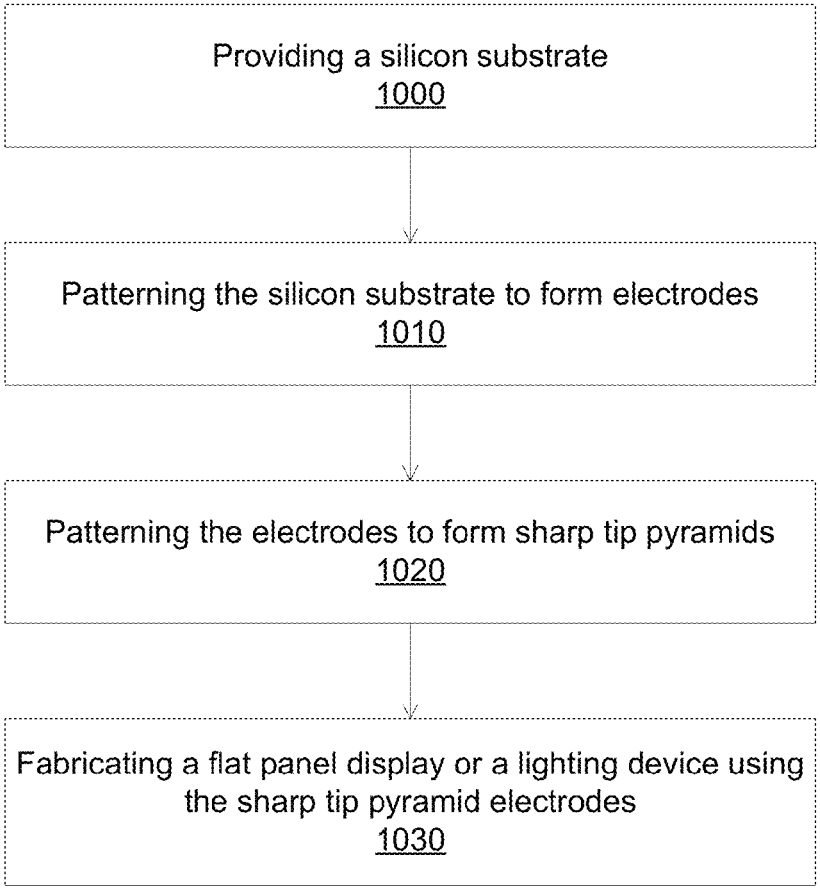
FIG. 10 illustrates a flow chart for fabricating a flat panel display or a lighting device according to some embodiments.

FIG. 10 illustrates a flow chart for fabricating a flat panel display or a lighting device according to some embodiments. In operation 1000, a silicon substrate can be provided. The silicon substrate can include a single crystal silicon having (100) crystal orientation, or a silicon containing substrate. In operation 1010, the silicon substrate can be patterned to form electrodes. For example, parallel lines can be patterned for cross line array electrodes. In operation 1020, the electrodes are patterned, such as wet etch, to form (111) pyramids. In operation 1030, the pyramid patterned electrodes can be used in the fabrication of flat panel displays, such as a plasma display panel, a field emission display, or a lighting device.

Figure 11:
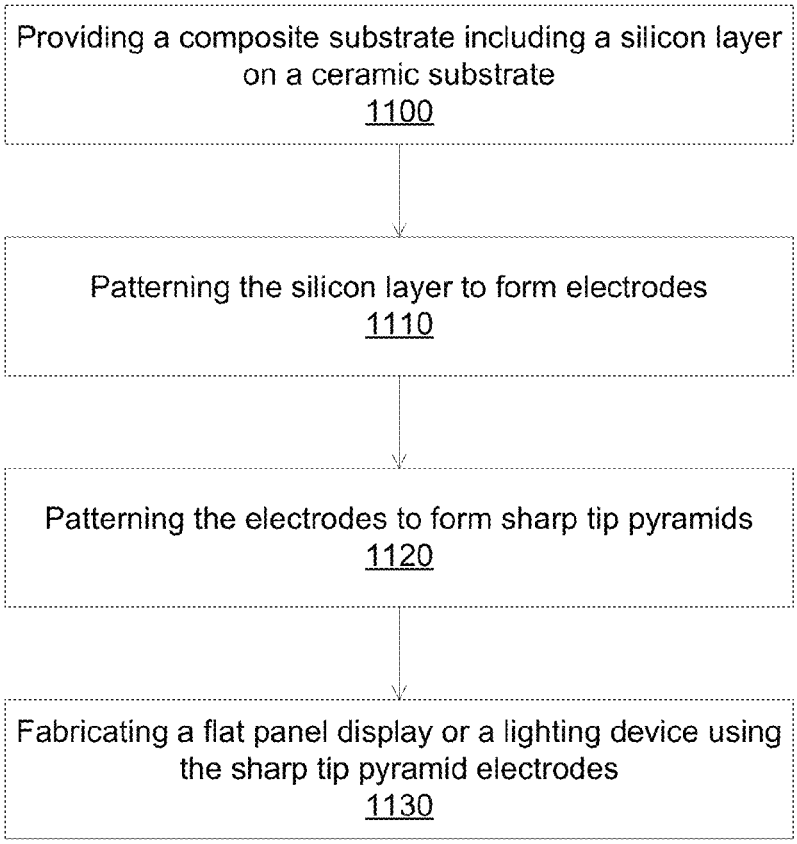
FIG. 11 illustrates a flow chart for fabricating a flat panel display or a lighting device according to some embodiments.

FIG. 11 illustrates a flow chart for fabricating a flat panel display or a lighting device according to some embodiments. In operation 1100, a composite substrate can be provided. The composite substrate can include a silicon layer disposed on an insulating substrate. For example, the composite substrate can include a (100) single crystal silicon layer on a ceramic substrate. The composite substrate can be fabricated by exfoliating a layer of silicon from a silicon substrate, and bonding the silicon layer to a ceramic substrate through high temperature annealing. In operation 1110, the silicon layer can be patterned to form electrodes. For example, parallel lines can be patterned for cross line array electrodes. In operation 1120, the electrodes are patterned, such as wet etch, to form (111) pyramids. In operation 1130, the pyramid patterned electrodes can be used in the fabrication of flat panel displays, such as a plasma display panel, a field emission display, or a lighting device.

What is claimed is:

1. A method for forming a flat panel display, comprising
providing a substrate, wherein the substrate comprises a (100) silicon crystal orientation;
patterning the substrate to form a plurality of lines, wherein the plurality of lines comprises an external surface;
patterning the external surface to form a plurality of (111) silicon pyramid shape structures on the external surface;
forming a flat panel display using the substrate as an electrode.

2. A method as in claim 1 wherein the substrate comprises a layer of silicon disposed on an insulating substrate.

3. A method as in claim 1 wherein the substrate comprises a layer of silicon disposed on a ceramic substrate.

4. A method as in claim 1 wherein providing a substrate comprises
bonding a layer of silicon to a ceramic paste;
annealing the ceramic paste to solidify the ceramic paste.

5. A method as in claim 1 further comprising
exfoliating a layer of silicon from a silicon substrate before bonding the layer of silicon to the ceramic paste.

6. A method as in claim 1 wherein patterning the substrate to form a plurality of lines is performed by a photolithography process.

7. A method as in claim 1 wherein patterning the substrate to form a plurality of lines comprises
coating a layer of photoresist on the substrate;
patterning the layer of photoresist;
etching the substrate, using the layer of photoresist as a mask;
removing the layer of photoresist.

8. A method as in claim 1 wherein patterning the lines to form the pyramid shape structures is performed by a wet etch process.

9. A method as in claim 1 wherein patterning the lines to form the pyramid shape structures comprises
exposing the substrate to a silicon etching solution.

10. A method as in claim 1 wherein patterning the lines to form the pyramid shape structures comprises
exposing the substrate to a solution comprising tetramethylammonium hydroxide.

11. A method as in claim 1 wherein patterning the lines to form the pyramid shape structures comprises
exposing the substrate to a solution comprising potassium hydroxide.

12. A method as in claim 1 wherein the flat panel display comprises a plasma display panel or a field emission display.

13. A method as in claim 1 wherein the substrate having the pyramid shape structures form data electrodes for the flat panel display.

14. A method as in claim 1 wherein the substrate having the pyramid shape structures form scan or display electrodes for the flat panel display.

15. A flat panel display comprising
a first plate;
a second plate disposed opposite to the first plate and spaced from the first plate,
barrier ribs disposed within the space between the first and second plates, wherein the barrier ribs partition the space between the first and second plates into a plurality of discharge cells,
first electrodes coupled to the first plate;
second electrodes coupled to the second plate, wherein each discharge cell is exposed to at least a first electrode or a second electrode,
wherein at least the first electrodes or the second electrodes comprise (111) silicon pyramid shape structures on an external surface.

16. A flat panel display as in claim 15 wherein the first electrodes or the second electrodes comprises a layer of silicon disposed on a ceramic substrate, wherein the layer of silicon comprises (111) silicon pyramid shape structures.

17. A flat panel display as in claim 15 wherein the flat panel display comprises a plasma display panel.

18. A flat panel display as in claim 15 wherein the flat panel display comprises a field emission display.

19. An electrode plate for a flat panel display, comprising
a substrate;
a plurality of lines disposed on the substrate, wherein the lines comprise a plurality of (111) silicon pyramid shape structures on an external surface.

20. An electrode plate as in claim 19 wherein the substrate comprises a layer of silicon disposed on a ceramic substrate, wherein the layer of silicon comprises (111) silicon pyramid shape structures.

* * * * *